US011566877B1

(12) United States Patent
Beal

(10) Patent No.: US 11,566,877 B1
(45) Date of Patent: Jan. 31, 2023

(54) GLASS PENETRATING PROJECTILE

(71) Applicant: Lone Star Future Weapons, LLC, Garland, TX (US)

(72) Inventor: Harold F. Beal, University Park, TX (US)

(73) Assignee: True Velocity IP Holdings, LLC, Garland, TX (US)

( * ) Notice: Subject to any disclaimer, the term of this patent is extended or adjusted under 35 U.S.C. 154(b) by 0 days.

(21) Appl. No.: 17/467,515

(22) Filed: Sep. 7, 2021

(51) Int. Cl.
*F42B 12/06* (2006.01)
*F42B 12/34* (2006.01)

(52) U.S. Cl.
CPC ..... *F42B 12/06* (2013.01); *F42B 12/34* (2013.01)

(58) Field of Classification Search
CPC ..... F42B 12/78; F42B 12/76; F42B 12/06
USPC ..... 102/509, 503, 514, 515, 516, 439; 86/55
See application file for complete search history.

(56) References Cited

U.S. PATENT DOCUMENTS

| | | | | |
|---|---|---|---|---|
| 3,132,591 | A * | 5/1964 | Rapp | F42B 12/78 102/509 |
| 6,360,667 | B1 * | 3/2002 | Nisimura | F42B 10/34 102/503 |
| 7,597,037 | B2 * | 10/2009 | Beal | F42B 12/34 86/53 |
| 2019/0277610 | A1 * | 9/2019 | Eberhart | F42B 12/34 |
| 2021/0341276 | A1 * | 11/2021 | Jones | F42B 12/745 |

FOREIGN PATENT DOCUMENTS

| | | | | |
|---|---|---|---|---|
| DE | 3840165 | A1 * | 7/1990 | |
| DE | 10045009 | A1 * | 5/2001 | F42B 12/34 |
| EP | 2498046 | A1 * | 9/2012 | F42B 12/06 |

* cited by examiner

*Primary Examiner* — Reginald S Tillman, Jr.
(74) *Attorney, Agent, or Firm* — Burdick Patents, P.A.; Sean Burdick

(57) ABSTRACT

A projectile for use in a firearm ammunition cartridge, and a method of forming the projectile, the projectile including a core, and a jacket in which the core is disposed, the jacket having a closed rearward end and an open forward end, the forward end tapering inwardly toward a longitudinal centerline of the jacket to define an ogive portion of the projectile, wherein the forward end of the jacket terminates in a plane that is perpendicular to the longitudinal centerline of the jacket, and wherein an outer perimeter of the forward end of the jacket has a machined sharp edge.

16 Claims, 5 Drawing Sheets

GLASS PENETRATING PROJECTILE

CROSS-REFERENCE TO RELATED APPLICATIONS

Not applicable.

FIELD OF INVENTION

The present general inventive concept relates to firearm ammunition and methods of manufacture thereof, and, more particularly, to firearm ammunition designed to effectively penetrate glass.

BACKGROUND

Ammunition cartridges of the type commonly used in modern firearms are generally known in the art. An ammunition cartridge typically includes a generally cylindrical case which is sized and shaped to correspond to the interior of a firing chamber of a firearm. The case includes an open leading end having a projectile held therein. When the cartridge is received within the chamber, the leading end of the case carrying the projectile faces toward and along the bore of the firearm.

Lead, compacted metal powders, etc., are typically loaded into a jacket, such as a cup-shaped copper metal jacket. The core in the jacket is seated against the closed end of the jacket ("core seating"), and the open end of the jacket is formed about the core and shaped to define an aerodynamically desirable leading end of the projectile. For purposes of at least partially closing the open end of the jacket while defining the desired aerodynamic shape on that end of the core/jacket combination which will become the leading end of the projectile when it is fired from a gun, the core is chosen to be shorter in length than the depth of the jacket so that there is a portion of the jacket wall adjacent the open end of the jacket which is void of core material when the seating operation has been completed.

Core seating may take place with the core/jacket combination being held in a die while pressure is applied axially of the core to seat the core within the closed end of the jacket, and, in part, to the side wall of the jacket. Thereafter, and usually in a different die, the open end of the jacket is formed inwardly toward the longitudinal centerline of the jacket. This operation may take place in steps, and may involve more than one die, but in the end, the initially open end of the jacket is closed to the extend desired. The initially open end of the jacket may be fully closed or partially closed, in part depending upon the desired terminal ballistics of the projectile.

Regardless of the configuration of the leading end of the projectile, these rounds are often prone to bounce or glance off of a surface such as glass when striking at an angle. For example, some proponents of larger caliber ammunition believe that smaller calibers, such as 9 mm, are extremely prone to bounce off of windshields or other glass surfaces without inflicting any damage at all. Therefore, it may be desirable to design a round that will perform better when striking a glass surface at an angle.

BRIEF SUMMARY

According to various example embodiments of the present general inventive concept, a projectile is formed with a sharp edge about a leading tip thereof to improve glass penetration.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a projectile for use in a firearm ammunition cartridge, and a method of forming the projectile, the projectile including a core, and a jacket in which the core is disposed, the jacket having a closed rearward end and an open forward end, the forward end tapering inwardly toward a longitudinal centerline of the jacket to define an ogive portion of the projectile, wherein the forward end of the jacket terminates in a plane that is perpendicular to the longitudinal centerline of the jacket, and wherein an outer perimeter of the forward end of the jacket has a machined sharp edge.

The foregoing and/or other aspects and advantages of the present general inventive concept may also be achieved by providing a method of forming a projectile for use in a firearm ammunition cartridge, the method including providing a jacket having a closed rearward end and an open forward end, disposing a core inside the jacket, tapering the forward end of the jacket inwardly toward a longitudinal centerline of the jacket to define an ogive portion of the projectile, and machining the forward end of the jacket such that it terminates in a plane that is perpendicular to the longitudinal centerline of the jacket, and such that an outer perimeter of the forward end of the jacket has a sharp edge.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a projectile is provided that has improved impact characteristics when striking a glass surface. Further, it is understood that although the embodiments described herein typically refer to how the example embodiment projectiles strike glass surfaces, the impact and interaction with other surfaces may also be improved by the present general inventive concept.

Figure 2:
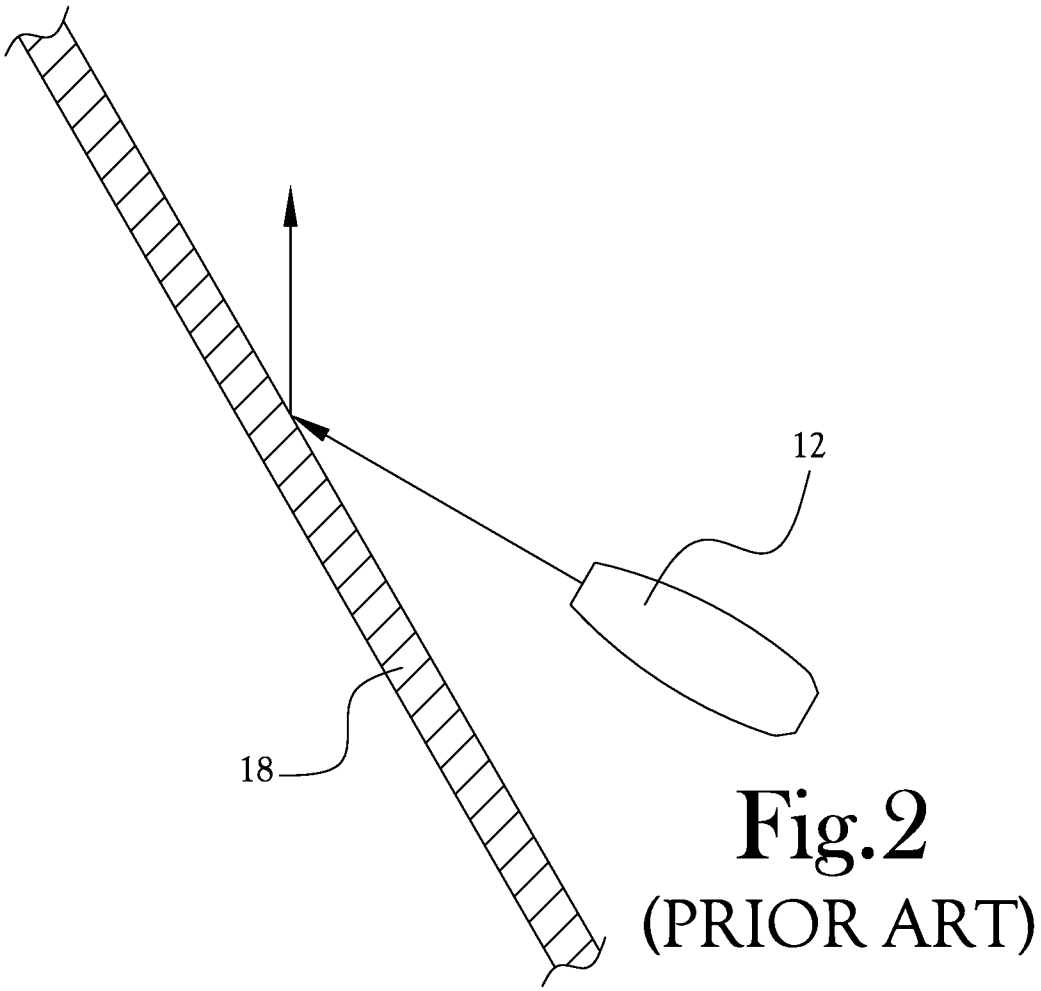
Fig. 2 (PRIOR ART)
FIG. 2 illustrates a projectile from the cartridge of FIG. 1 glancing off of a glass surface.
Figure 1:
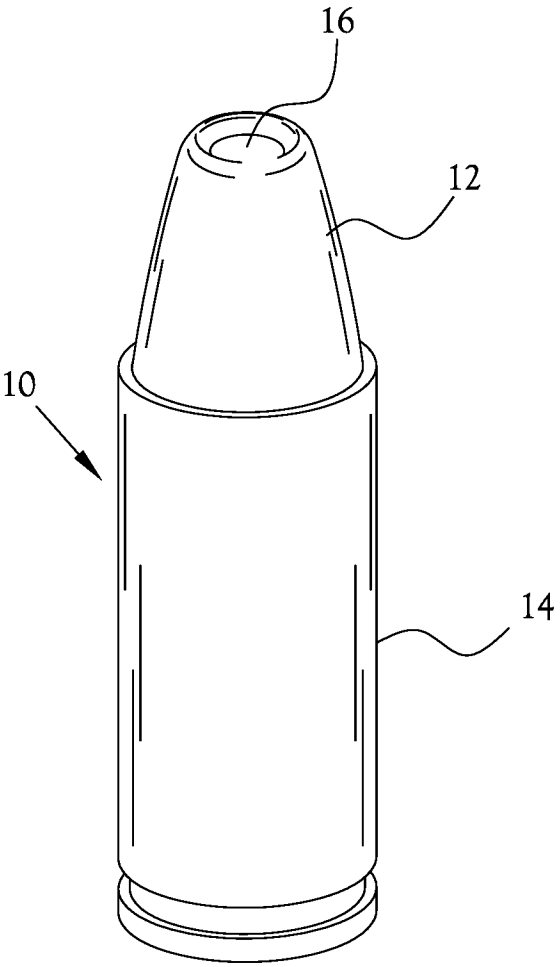
Fig. 1 (PRIOR ART)
FIG. 1 illustrates a typical conventional firearm cartridge.

FIG. 1 illustrates a typical conventional firearm cartridge. The conventional cartridge 10 has a jacketed projectile 12 disposed in a casing 14, and terminates in a hollow point tip 16. The hollow point tip 16 has been conventionally formed by bending back a portion of the jacket into the hollow space of the hollow point tip 16, and thus the cartridge 10 terminates in a rounded leading end. FIG. 2 illustrates the projectile 18 from the cartridge 10 of FIG. 1 glancing off of a glass surface 18. As illustrated in FIG. 2, as the projectile 12 approaches the glass surface 18 at an angle, the projectile 10 skips off of the glass surface, causing little or no damage to the glass surface 18. Such performance is similar with a host of differently configured rounds of ammunition. As discussed herein, a user may want to have access to a firearm round that will be more suited to "gripping" the glass, rather than glancing off and potentially causing unwanted damage to bystanders or other property.

Figure 3:
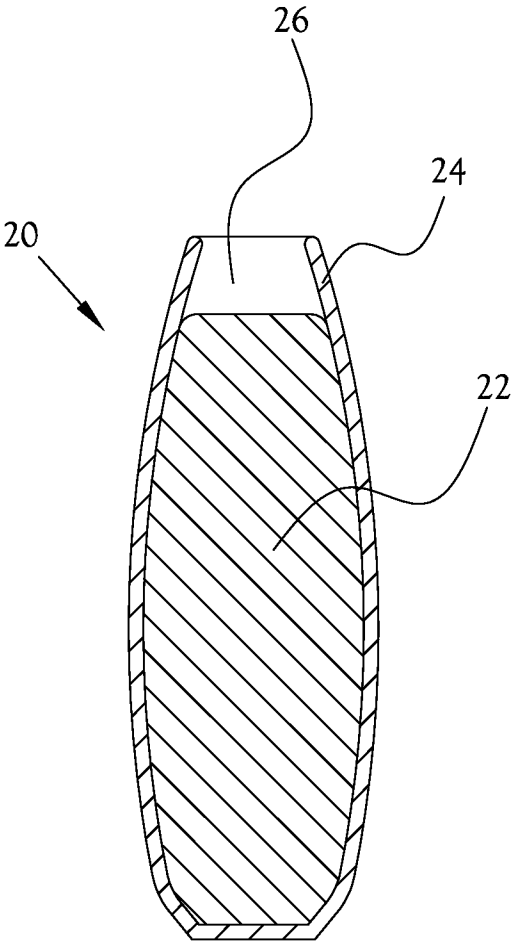
FIG. 3 illustrates a cross section of an initial phase of a firearm projectile being constructed according to an example embodiment of the present general inventive concept.

FIG. 3 illustrates a cross section of an initial phase of a firearm projectile being constructed according to an example embodiment of the present general inventive concept. In the example embodiment illustrated in FIG. 3, an initial form of the projectile 20 is formed by seating a core 22 in a jacket 24, and forming the jacket 24 into the desired shape. This may include forming the base of the projectile 20 into, for example, a flat or boat tail configuration, and may also include tapering the leading end of the jacket 24 into a tapered ogive portion of the cartridge 20. Various example embodiments may provide a core 22 that is formed of lead, pressed powders, etc., and a substantially cylindrical jacket 24 that is formed of one or more metals, such as copper, or even synthetic alloys, the jacket 24 being harder than the core 22. As illustrated in FIG. 3, the jacket 24 extends past the forward end of the core 22 to form a hollow space 26 that is part of the hollow point round.

Figure 4A:
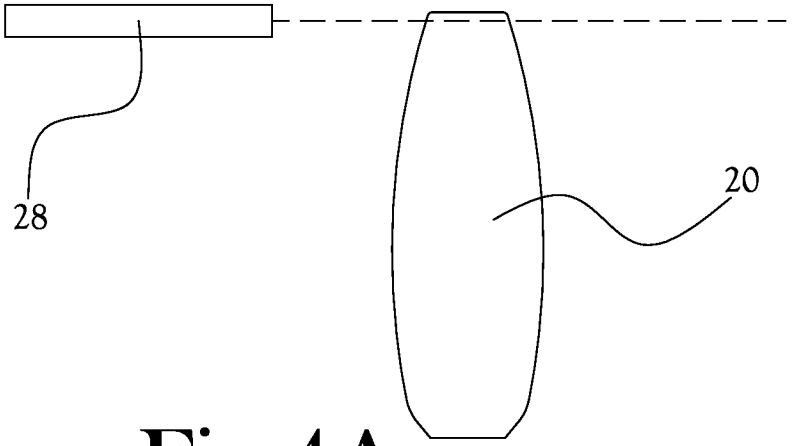
FIGS. 4A-4B illustrate a leading tip of the firearm projectile of FIG. 3 being machined to produce a sharp edge according to an example embodiment of the present general inventive concept.
Figure 4B:
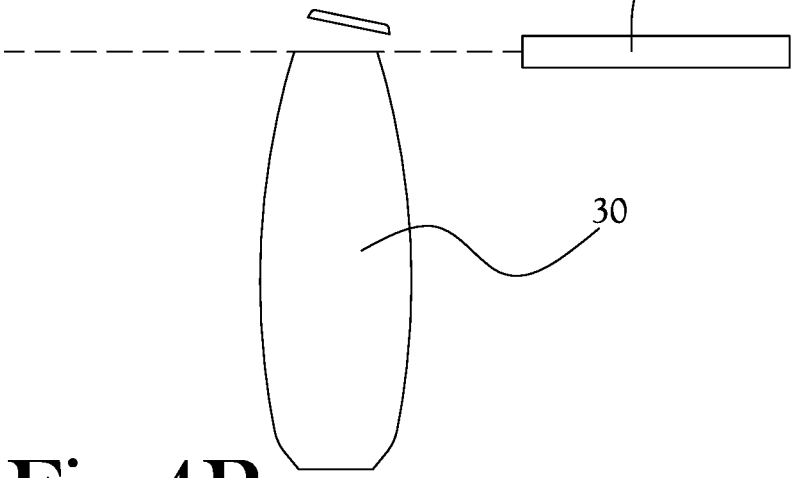
Figure 5:
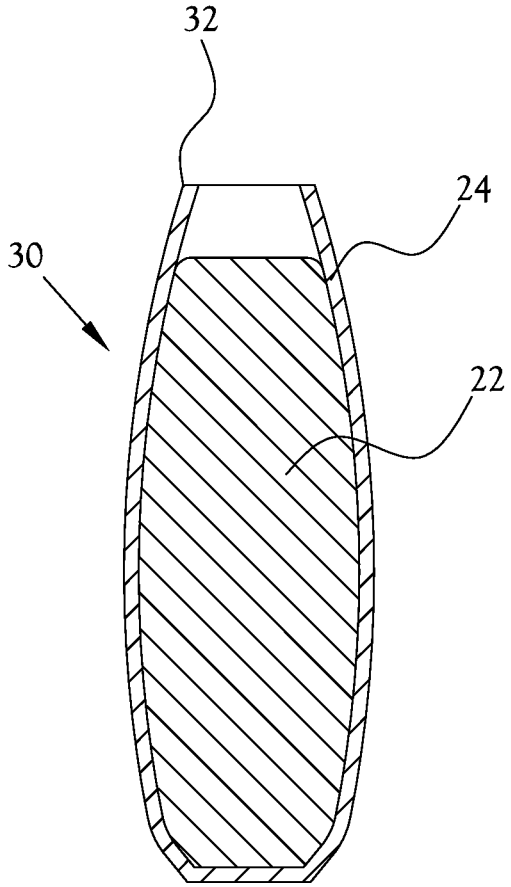
FIG. 5 illustrates a cross section of the firearm projectile of FIG. 3 after machining.

FIGS. 4A-4B illustrate a leading tip of the firearm projectile 20 of FIG. 3 being machined to produce a sharp edge according to an example embodiment of the present general inventive concept, and FIG. 5 illustrates a cross section of the firearm projectile after this machining. In this example embodiment, a carbide tipped saw blade 28 is used to cut a portion of the leading end off of the projectile 20 such that the resulting projectile 30 has a flat leading end 32 that is perpendicular to a longitudinal centerline of the jacket 24, or the longitudinal axis of the projectile 30. While the example embodiment illustrated in FIGS. 4A-5 shows an open end of the projectile 20, it is understood that this process can also be used on a closed end projectile to create the desired sharp edge, whether or not the round is desired to be a hollow point round. The precision cut from the machining results in a crisp and extremely sharp edge 32 around the outer perimeter of the leading end of the projectile 30. The same precision edge may also be present on the inner perimeter of the leading end of the projectile 30. Such a sharp edge 32 may be substantially continuous around the entire perimeter, without any chips, breaks, etc., that may interrupt the cutting performance of the sharp edge of the projectile when contacting glass or other flat surfaces. In various example embodiments, further machining may be performed to refine the sharp edge 32 around the leading end of the projectile 30. The crisp and sharp edge 32 at the leading end of the projectile 30 minimizes contact between the glass surface and the rest of the projectile 30, particularly at the initial impact, increasing the bite of the leading end of the projectile 30 onto the glass surface 18.

Figure 6:
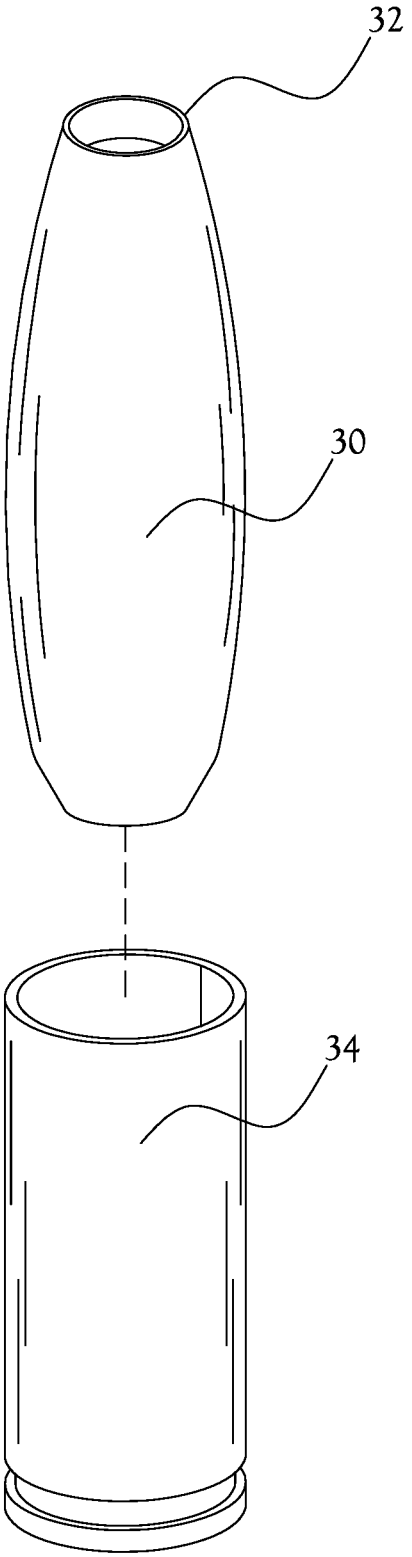
FIG. 6 illustrates the firearm projectile of FIG. 5 being placed in a cartridge casing.
Figure 8:
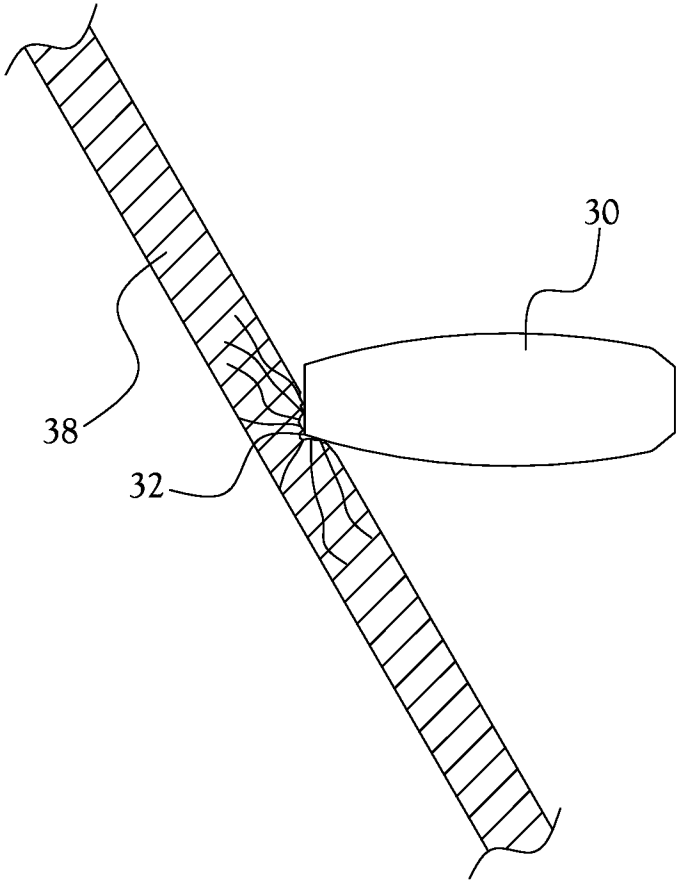
FIG. 8 illustrates an impact made on a glass surface by a projectile formed according to an example embodiment of the present general inventive concept.
Figure 7:
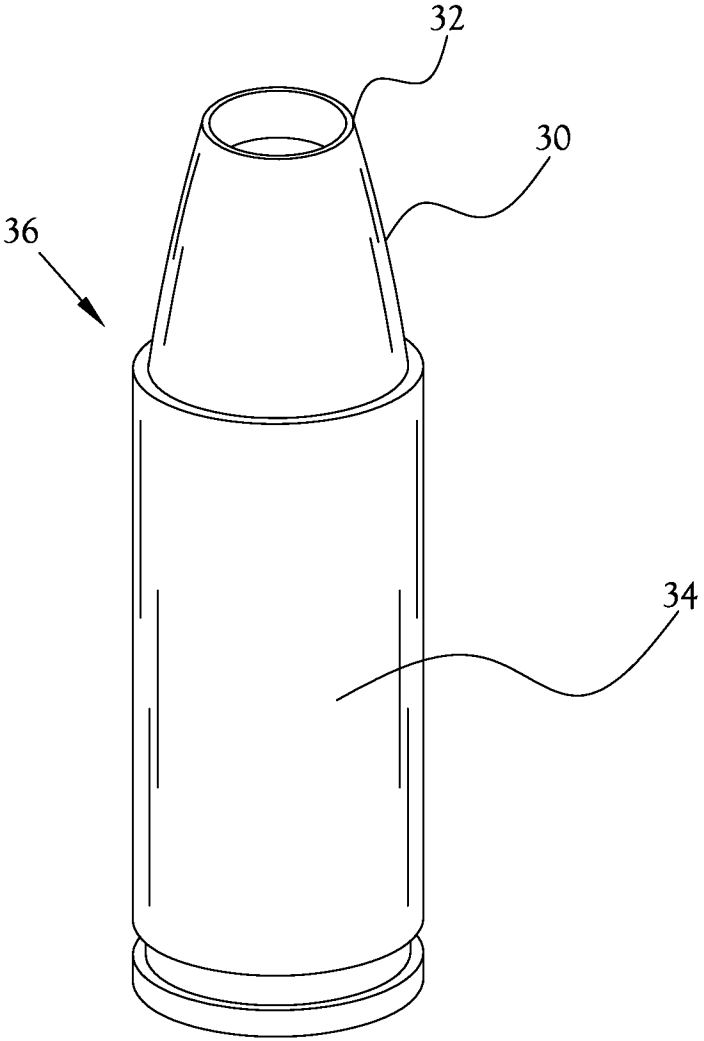
FIG. 7 illustrates the firearm cartridge being formed in FIG. 6.

FIG. 6 illustrates the firearm projectile 30 of FIG. 5 being placed in a cartridge casing 34, and FIG. 7 illustrates the firearm cartridge 36 being formed in FIG. 6. As illustrated, the finished cartridge 36 includes the projectile 30 having the machined sharp edge 32 designed to more effectively cut into glass and other flat surfaces to minimize glancing, bouncing, ricochets, etc. FIG. 8 illustrates an impact made on a glass surface 38 by the projectile 30 formed according to an example embodiment of the present general inventive concept. As illustrated in FIG. 8, the sharp perimeter edge 32 of the leading end of the projectile 30 makes the first contact with the glass surface 38 when striking at an angle. The shar edge 32 is able to engage the glass by, for example, chipping, cracking, or otherwise damaging the glass surface 38, and the resulting damage provides a non-smooth surface for the remainder of the projectile 30 to interact with, reducing the chances of the round simply bouncing off of the glass surface 38.

Figure 9:
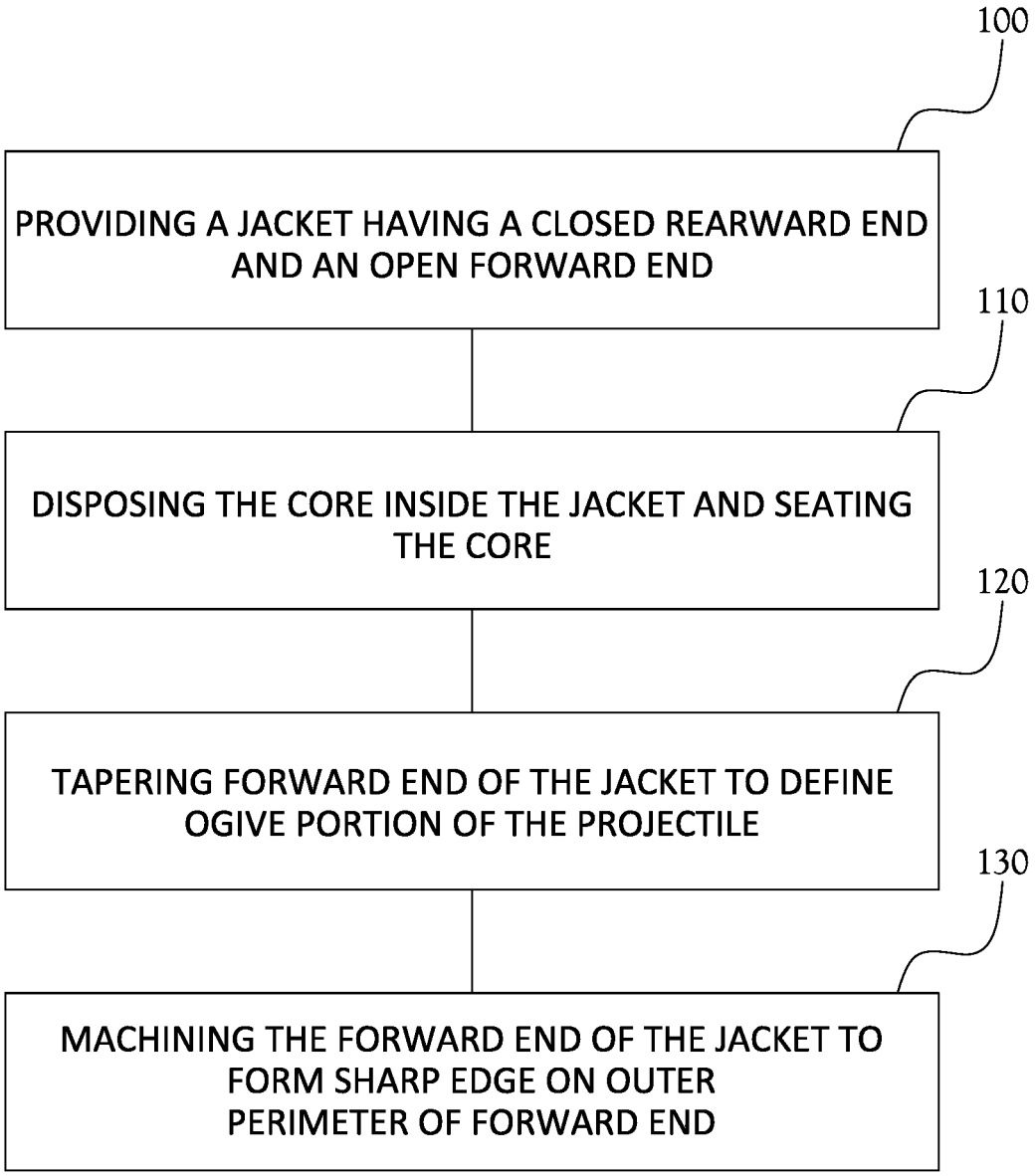
FIG. 9 illustrates a method of forming a projectile for use in a firearm ammunition cartridge according to an example embodiment of the present general inventive concept.

FIG. 9 illustrates a method of forming a projectile for use in a firearm ammunition cartridge according to an example embodiment of the present general inventive concept. It is understood that the flow chart illustrating this method is simply one example embodiment of the present general inventive concept, and various other example embodiments may include more or fewer operations, and which may be performed in different orders and with various different components without departing from the scope of the present general inventive concept. In operation 100, a cylindrical copper jacket is provided that has a closed rearward end and an open forward end. In operation 110, a bullet core is disposed inside the jacket, and the core is seated in the bottom of the jacket. In operation 120, the jacket, along with the core seated inside, is shaped such that the bottom or base has the desired form, and the forward end is tapered to define the ogive portion of the projectile. In operation 130, the forward end of the projectile is machined to form the sharp edge on the edge of forward end of the projectile.

Various example embodiments of the present general inventive concept may provide a projectile for use in a firearm ammunition cartridge, the projectile including a core, and a jacket in which the core is disposed, the jacket having a closed rearward end and an open forward end, the forward end tapering inwardly toward a longitudinal centerline of the jacket to define an ogive portion of the projectile, wherein the forward end of the jacket terminates in a plane that is perpendicular to the longitudinal centerline of the jacket, and wherein an outer perimeter of the forward end of the jacket has a machined sharp edge. An inner perimeter of the forward end of the jacket may also have a machined sharp edge. The machined sharp edge of the outer perimeter may be configured to cut glass. The forward end of the jacket may extend past a forward end of the core to form an open space inside the jacket between the forward end of the core and the forward end of the jacket. The core may be formed with material softer than the jacket. An outer surface of the jacket adjacent the forward end of the jacket may be continuous. The forward end of the jacket may include a plurality of rib cuts extending back from the forward end to facilitate expansion of the jacket upon impact of the projectile. The jacket may be formed at least of copper.

Various example embodiments of the present general inventive concept may provide a method of forming a projectile for use in a firearm ammunition cartridge, the method including providing a jacket having a closed rearward end and an open forward end, disposing a core inside the jacket, tapering the forward end of the jacket inwardly toward a longitudinal centerline of the jacket to define an ogive portion of the projectile, and machining the forward end of the jacket such that it terminates in a plane that is perpendicular to the longitudinal centerline of the jacket, and such that an outer perimeter of the forward end of the jacket has a sharp edge. The machining of the forward end of the jacket may include cutting off a portion the forward end of the jacket. The machining of the forward end of the jacket may include sawing the forward end with a carbide tipped saw blade. The machining of the forward end may also form a sharp edge on an inner perimeter of the forward end of the jacket. The method may further include machining the sharp edge of the outer perimeter so as to be configured to cut glass. The disposing of the core may include inserting and seating the core in the jacket. The method may further include forming the rearward end of the jacket into a flat or boat tail configuration. The method may further include forming the ogive portion of the projectile such that the jacket extends past a forward end of the core to form an open space inside the jacket between the forward end of the core and the forward end of the jacket. The method may further include cutting a plurality of rib cuts extending back from the forward end of the jacket to facilitate expansion of the jacket upon impact of the projectile.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A projectile for use in a firearm ammunition cartridge, the projectile comprising:

a core; and a jacket in which the core is disposed, the jacket having a closed rearward end and an open forward end, the forward end tapering inwardly toward a longitudinal centerline of the jacket to define an ogive portion of the projectile;

wherein the forward end of the jacket terminates in a plane that is perpendicular to the longitudinal centerline of the jacket and extends past a forward end of the core to form an open space inside the forward end of the jacket and between the forward end of the core; and wherein an outer perimeter of the forward end of the jacket has a machined sharp edge.

2. The projectile of claim 1, wherein an inner perimeter of the forward end of the jacket has a machined sharp edge.

3. The projectile of claim 1, wherein the machined sharp edge of the outer perimeter is configured to cut glass.

4. The projectile of claim 1, wherein the core is formed with material softer than the jacket.

5. The projectile of claim 1, wherein an outer surface of the jacket adjacent the forward end of the jacket is continuous.

6. A projectile for use in a firearm ammunition cartridge, the projectile comprising:

a core; and a jacket in which the core is disposed, the jacket having a closed rearward end and an open forward end, the forward end tapering inwardly toward a longitudinal centerline of the jacket to define an ogive portion of the projectile;

wherein the forward end of the jacket terminates in a plane that is perpendicular to the longitudinal centerline of the jacket;

wherein an outer perimeter of the forward end of the jacket has a machined sharp edge; and wherein the forward end of the jacket comprises a plurality of rib cuts extending back from the forward end to facilitate expansion of the jacket upon impact of the projectile.

7. A projectile for use in a firearm ammunition cartridge, the projectile comprising:

a core; and a jacket in which the core is disposed, the jacket having a closed rearward end and an open forward end, the forward end tapering inwardly toward a longitudinal centerline of the jacket to define an ogive portion of the projectile;

wherein the forward end of the jacket terminates in a plane that is perpendicular to the longitudinal centerline of the jacket;

wherein an outer perimeter of the forward end of the jacket has a machined sharp edge; and wherein the jacket comprises copper.

8. A method of forming a projectile for use in a firearm ammunition cartridge, the method comprising:

providing a jacket having a closed rearward end and an open forward end; disposing a core inside the jacket;

tapering the forward end of the jacket inwardly toward a longitudinal centerline of the jacket to define an ogive portion of the projectile; and machining the forward end of the jacket such that it terminates in a plane that is perpendicular to the longitudinal centerline of the jacket, and such that an outer perimeter of the forward end of the jacket has a sharp edge.

9. The method of claim 8, wherein the machining of the forward end of the jacket comprises cutting off a portion the forward end of the jacket.

10. The method of claim 8, wherein the machining of the forward end of the jacket comprises sawing the forward end with a carbide tipped saw blade.

11. The method of claim 8, wherein the machining of the forward end also forms a sharp edge on an inner perimeter of the forward end of the jacket.

12. The method of claim 8, further comprising machining the sharp edge of the outer perimeter so as to be configured to cut glass.

13. The method of claim 8, wherein the disposing of the core comprises inserting and seating the core in the jacket.

14. The method of claim 8, further comprising forming the rearward end of the jacket into a flat or boat tail configuration.

15. The method of claim 8, further comprising forming the ogive portion of the projectile such that the jacket extends past a forward end of the core to form an open space inside the jacket between the forward end of the core and the forward end of the jacket.

16. The method of claim 8, further comprising cutting a plurality of rib cuts extending back from the forward end of the jacket to facilitate expansion of the jacket upon impact of the projectile.

* * * * *